United States Patent [19]

Nielsen et al.

[11] Patent Number: 5,011,739

[45] Date of Patent: Apr. 30, 1991

[54] MOISTURE STABLE BIASABLE TRANSFER MEMBERS AND METHOD FOR MAKING SAME

[75] Inventors: Paul L. Nielsen; John C. Wilson, both of Rochester, N.Y.

[73] Assignee: Eastman Kodak Company, Rochester, N.Y.

[21] Appl. No.: 416,100

[22] Filed: Oct. 2, 1989

[51] Int. Cl.[5] ..... G03G 15/06

[52] U.S. Cl. ..... 428/425.8; 355/274

[58] Field of Search ..... 430/127; 355/259, 274; 428/425.8, 425.9

[56] References Cited

U.S. PATENT DOCUMENTS

| | | | |
|---|---|---|---|
| 2,807,233 | 9/1957 | Fitch | 118/637 |
| 2,836,725 | 5/1958 | Vyververg | 250/49.5 |
| 2,951,443 | 9/1960 | Byrne | 101/426 |
| 2,969,386 | 1/1961 | McElroy | 260/471 |
| 3,379,687 | 4/1968 | Doss et al. | 260/47 |
| 3,455,855 | 7/1969 | Houghton et al. | 260/18 |
| 3,520,604 | 7/1970 | Shelffo | 355/16 |
| 3,552,972 | 1/1971 | Meyer et al. | 96/87 |

(List continued on next page.)

FOREIGN PATENT DOCUMENTS

| | | |
|---|---|---|
| 2820609 | 11/1979 | Fed. Rep. of Germany . |
| 3223119 | 12/1983 | Fed. Rep. of Germany . |
| 2568574 | 12/1986 | France . |
| 49-27675 | 7/1974 | Japan . |
| 1071627 | 2/1984 | U.S.S.R. . |
| 2143539 | 2/1985 | United Kingdom . |
| 2205437 | 12/1988 | United Kingdom . |

OTHER PUBLICATIONS

Sieger, H., "Stoichiometric Alkaline Earth Salt Complexes of Ethylene Glycols", Tetrahedren Letters, No. 30, pp. 2709–2710, Pergamon Press Ltd. (1978).

*Primary Examiner*—John Goodrow

*Attorney, Agent, or Firm*—Willard G. Montgomery

[57] ABSTRACT

The invention provides rolls, belts and other biasable members having at least one layer or coating of an elastomeric resilient crosslinked polyurethane formed by reacting (a) a polyisocyanate prepolymer comprising the reaction product of an aliphatic polyisocyanate and a polyether polyol, specifically a polyalkylene glycol in which the alkylene group contains 2 to 3 carbon atoms, and (b) a hardening mixture comprising a polyether polyol of (a) and, as a conductivity control agent, from 0.01 to 3.0 weight percent based on the total weight of (b) of a complex of an oligoethylene glycol selected from the group consisting of di-, tri- and tetraethylene glycol with an ionizable alkali metal salt selected from the group consisting of sodium iodide, lithium iodide and sodium thiocyanate.

The resistivity of the elastomeric resilient polyurethane coating on the biasable member is controlled or adjusted to within a desired level of resistivity due to the inclusion of the conductivity control agent in the crosslinked polyurethane elastomer. Additionally, the inclusion of the conductivity control agent in the crosslinked polyurethane elastomer reduces the sensitivity of the resistivity of the polyurethane coating on the biasable member to changes in relative humidity. Further, since the conductivity control agent is copolymerized with the polyisocyanate prepolymers and polyols used to make the elastomeric polyurethane coatings of the biasable members of the invention, the conductivity control agent is bonded covalently to the backbone and/or the crosslinking portion of the polyurethane elastomer where it forms a permanently fixed part of the crosslinked polymer and will not migrate therefrom resulting in a continuous change in the resistivity of the polyurethane coating over time and possible adverse affects on materials that may come into contact with the migrating agent. The utility of such biasable members is in the transfer of toner images from a photoconductor to a final support sheet where the member, for example, a bias transfer roll, electrically cooperates with a photoconductor to establish a directional force field therebetween.

29 Claims, 1 Drawing Sheet

U.S. PATENT DOCUMENTS

| | | | |
|---|---|---|---|
| 3,620,616 | 11/1971 | Davidson et al. | 355/3 |
| 3,633,543 | 1/1972 | Pitasi et al. | 118/621 |
| 3,694,413 | 9/1972 | Batzer et al. | 260/75 |
| 3,702,482 | 11/1972 | Dolcimascolo et al. | 346/74 E S |
| 3,708,482 | 1/1973 | Lauria et al. | 260/247.7 |
| 3,769,022 | 10/1973 | Ville et al. | 96/114.5 |
| 3,781,105 | 12/1973 | Meagher | 355/3 |
| 3,920,325 | 11/1975 | Swift | 355/3 |
| 3,954,332 | 5/1976 | Fisher | 355/3 |
| 3,959,573 | 5/1976 | Eddy et al. | 428/425 |
| 3,959,574 | 5/1976 | Seanor et al. | 428/425 |
| 3,969,306 | 7/1976 | Borman et al. | 260/33.6 |
| 4,058,879 | 11/1977 | Lentz et al. | 428/424.7 |
| 4,062,812 | 12/1977 | Safford et al. | 252/500 |
| 4,113,649 | 9/1978 | Lehmkuhl et al. | 252/188 |
| 4,116,894 | 9/1978 | Lentz et al. | 428/413 |
| 4,200,701 | 4/1980 | Wetton et al. | 525/4 |
| 4,272,616 | 6/1981 | Kishimoto | 430/529 |
| 4,303,748 | 12/1981 | Armand et al. | 429/192 |
| 4,309,803 | 1/1982 | Blaszak | 29/130 |
| 4,357,401 | 11/1982 | Andre et al. | 429/192 |
| 4,365,036 | 12/1982 | Lee | 524/299 |
| 4,390,679 | 6/1983 | Weiss et al. | 528/64 |
| 4,405,741 | 9/1983 | Lee | 524/299 |
| 4,436,841 | 3/1984 | Rasshofer et al. | 521/106 |
| 4,438,251 | 3/1984 | Herweh | 528/73 |
| 4,471,037 | 9/1984 | Bannister | 429/191 |
| 4,476,292 | 10/1984 | Ham et al. | 528/60 |
| 4,476,297 | 10/1984 | Kablitz et al. | 528/486 |
| 4,542,095 | 9/1985 | Steklenski et al. | 430/527 |
| 4,547,440 | 10/1985 | Hooper et al. | 429/112 |
| 4,556,614 | 12/1985 | le Mehaute et al. | 429/191 |
| 4,654,279 | 3/1987 | Bauer et al. | 429/192 |
| 4,698,391 | 10/1987 | Yacobucci et al. | 525/162 |
| 4,729,925 | 3/1988 | Chen et al. | 428/425.8 |
| 4,762,941 | 8/1988 | Chen et al. | 558/44 |

MOISTURE STABLE BIASABLE TRANSFER MEMBERS AND METHOD FOR MAKING SAME

FIELD OF THE INVENTION

This invention relates generally to the field of electrostatography. More particularly, the invention relates to electrically biasable transfer members for use in electrostatographic transfer processes for transferring toner images from one support surface to another and to methods for their preparation.

BACKGROUND

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by imagewise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of dielectric material). Typically, the electrostatic latent image is then developed into a toner image by contacting the latent image with charged toner particles. If desired, the toner image can then be transferred to a final support material or receiver such as a web or sheet of paper and affixed thereto to form a permanent record of the original.

Historically, the transfer of toner images between supporting surfaces has been accomplished with the electrostatic transfer of either a corotron or a roller or belt electrode biased to a certain potential, such electrode being referred to as a bias transfer member (roll or belt). In corona-induced transfer as, for example, disclosed by Vandenberg in U.S. Pat. No. 2,836,725, the final support sheet is placed in direct contact with the toner image while the image is supported on the photoconductive surface. The back of the sheet, that is, the side away from the image, is sprayed with a corona discharge having a polarity opposite to that carried by the toner particle causing the toner to be electrostatically transferred to the sheet. The corotron system is relatively simple. The charges deposited electrostatically tack the final support material, such as paper, to the original toner support, such as, the photoconductor, in addition to creating the desired electric field affecting transfer of the toner to the paper. However, the strong attraction between the paper and the original toner support makes it mechanically difficult to separate the two supports.

Transfer of developed images from the photoconductor to the final support material with the aid of a biased transfer member, such as a biased transfer roll, as a means of controlling the forces acting on the toner during transfer and of avoiding the severe tacking problems encountered with the use of the corona induction system have been tried with limited success. A bias transfer member is a member for electrically cooperating with a conductive support surface to attract electrically charged particles from the support surface towards the member. Bias transfer members are well known in the art. A bias transfer roll is disclosed by Fitch in U.S. Pat. No. 2,807,233 where a metal roll coated with a resilient coating having a resistivity of at least $10^6$ ohm cm is used as a bias transfer member. Because of the resistivity of the coating, the amount of bias that can be applied to the roll is limited to relatively low operating values because, at the higher ranges, the air in or about the transfer zone begins to break down, i.e., ionizes causing the image to be degraded during transfer. Shelffo, in U.S. Pat. No. 3,520,604, discloses a transfer roll made of a conductive rubber having a resistivity in the range of $10^{16}$ to $10^{11}$ ohm cm. Here, in order to give the roll the needed resiliency required in most practical applications, the coating must be relatively thick. A thick coating of high resistivity acts to build up a surface charge on the roll resulting in air break down in the transfer region and eventually copy degradation.

More recently, improved bias transfer members have been disclosed which reportedly have overcome many of the electrical and image degradation problems associated with some of the previous transfer techniques. Dolcimascolo et al, in U.S. Pat. No. 3,702,482, disclose a multiple layer transfer roll member for transferring xerographic images under controlled conditions. The member is capable of electrically cooperating with a conductive support surface to attract charged toner particles from the support surface towards the member or towards a transfer material such as paper positioned therebetween, the member having a conductive substrate for supporting a biased potential thereon, an intermediate blanket (primary layer) placed in contact with the substrate to the outer periphery of the blanket and a relatively thin outer coating (secondary layer) placed over the blanket layer having an electrical resistivity to minimize ionization of the atmosphere when the transfer member is placed in electrical cooperation with the image support surface and providing a good toner release property enabling the device to be cleaned of the toner. Meagher, in U.S. Pat. No. 3,781,105 discloses a similar transfer member employed in conjunction with a variable electrical bias means for regulating automatically the electrical field levels at various points on the transfer member during the transfer operation and providing constant current control.

In the preferred embodiment, the transfer member disclosed in U.S. Pat. No. 3,702,482 and U.S. Pat. No. 3,781,105 consists of a roller having a central biasable conductive core further having an intermediate blanket or electrically "relaxable" layer (primary layer) surrounding and in electrical contact with the core, and further having a second blanket or electrically "self-leveling" outer layer (secondary layer) surrounding and in electrical contact with the primary layer. Under operating conditions, it is desirable for optimal image transfer to maintain a relatively constant current flow of less than about 30 micro amps in the nip area between the transfer roll surface, transfer material, and photoconductive surface from which a developed image is to be transferred. For this condition to exist at given potentials, the resistivity of the primary and secondary layers must be within critical values and preferably be relatively constant under normally anticipated extremes of operating conditions. Preferably, it has been found that the primary layer should be a resilient elastomeric material having a volume resistivity within the range of $10^7$ to less than $10^{11}$ ohm cm, and the secondary layer should also be a resilient material having a volume resistivity within the range of $10^{11}$ to $10^{15}$ ohm cm.

In practice, it has been found that elastomeric materials used in the transfer member such as polyurethanes which exhibit resistivities within the above ranges, or the resistivities of which can be adjusted or controlled to within the above ranges, are moisture sensitive such that the resistivity may vary by as much as a factor of 50 between 10% and 80% relative humidity as a function of the amount of moisture absorbed from or lost to the surrounding atmosphere. For example, in the case of the polyurethane materials which are employed as the primary layer and which have exceptional good electrical characteristics, the volume resistivity may change from $10^{11}$ ohm cm at low moisture contents, i.e., less than about 0.1% moisture, to $10^{9}$ ohm cm at higher moisture levels, i.e., about 2.5% moisture. Other polyurethanes suitable for use as the secondary layer exhibit resistivity variations from about $10^{15}$ to $10^{13}$ ohm cm as a function of increasing moisture content. The consequent variations in resistivity due to relative humidity effects will ordinarily give rise to erratic performance of the transfer member from day to day particularly in terms of transfer efficiency, i.e., the quality of the image transferred unless compensated for by a concomitant change in the voltages sufficient to maintain a constant nip current, as disclosed by Meagher, in U.S. Pat. No. 3,781,105.

Several attempts have been made in the past both to control the resistivity of such materials to within the critical ranges necessary for optimal image transfer and, at the same time, to reduce the moisture sensitivity of such materials to changes in relative humidity so that the resistivity of the materials remains relatively constant within the ranges required for optimal image transfer. For example, Seanor et al, in U.S. Pat. No. 3,959,574, disclose that the resistivity of the elastomeric materials which constitute the primary layers of the multiple layer transfer roll members of Dolcimascolo et al, can be controlled to within the preferred resistivity range of about $10^{7}$ to about $10^{11}$ ohm cm and can be rendered less sensitive to changes in relative humidity by the addition of certain ionic compounds or agents to the elastomeric materials. Particularly preferred additives disclosed by Seanor et al are quaternary ammonium compounds, including tetraheptyl ammonium bromide, trimethyloctadecylammonium chloride, and benzyltrimethylammonium chloride. The additive compounds or agents of Seanor et al are worked into the polyurethane by direct melting of the additive into the polyurethane or by incorporating a solution or dispersion of the additive into the polyurethane. As a result, the additive agents of Seanor et al are not anchored in the elastomeric composition and are leached out of the elastomer over time during normal operations resulting in a decline in the level of conductivity in the polyurethane elastomers.

Chen et al, in U.S. Pat. No. 4,729,925 and U.S. Pat. No. 4,742,941 disclose, as coating materials for biasable transfer members, polyurethane elastomers made from certain polyisocyanate prepolymers and polyols in which the resistivity can be maintained between $1\times10^{9}$ and $1\times10^{11}$ ohm cm by copolymerizing with the polyisocyanate prepolymers and polyol hardening compounds used to make the polyurethane elastomers certain polyol charge-control agents formed from certain metal salts complexed with particular polyether diols such as, for example, bis[oxydiethylenebis(polycaprolactone)yl]5-sulfo-1,3-benzenedicarboxylate, methyltriphenylphosphonium salt. Unlike the additive control agents of Seanor et al, the polyol charge-control agents of Chen et al are not prone to being leached out of the elastomer during normal usage since they constitute an integral part of the cured polyurethane elastomer into which they are incorporated by virtue of having been copolymerized with the polyisocyanate prepolymers and polyol components used to make the polyurethane during the preparation of the elastomer. The polyurethane elastomers of Chen et al, however, are moisture sensitive. Reference to curve 2 in FIG. 2 of U.S. Pat. No. 4,729,925, indicates, for example, that the volume resistivity of the conductive polyurethane elastomer of Example 15 prepared from a commercial polyurethane mix and the polyol control agent of Example 10 therein i.e., bis[oxydiethylenebis(polycaprolactone)yl]5-sulfo-1,3-benzenedicarboxylate, methyltriphenylphosphonium salt, decreased by a factor of about 6.5 when the relative humidity changed from 25% to about 85%.

From the foregoing, it can be seen that there still remains a need in the art for a biasable transfer member capable of electrically cooperating with a conductive support surface to attract charged toner particles towards the member or towards a transfer material such as a sheet of paper positioned between the member and the conductive support in which the resistivity not only can be controlled or adjusted to within a specific range necessary for optimal image transfer but also one in which the resistivity is substantially insensitive to widely varying changes in relative humidity encountered during normal operating conditions such that the resistivity remains relatively constant within the range required for optimal image transfer. The present invention provides such a biasable transfer member and methods for making same.

SUMMARY OF THE INVENTION

The present invention provides a biasable transfer member, that is, a member capable of electrically cooperating with a conductive support surface to attract charged toner particles from the support surface towards the member. The biasable transfer member comprises a conductive substrate capable of supporting a uniform bias potential thereon and at least one coating comprising a resilient crosslinked elastomeric polyurethane formed by reacting:

(a) a polyisocyanate prepolymer comprising the reaction product of:
  (i) an aliphatic polyisocyanate, and
  (ii) a polyether polyol selected from the group consisting of a polyalkylene glycol having 2 to 3 carbon atoms in the alkylene group; and
(b) a hardening mixture comprising:
  (i) a polyether polyol selected from the group consisting of a polyalkylene glycol having 2 to 3 carbon atoms in the alkylene group and,
  (ii) as a conductivity-control agent for controlling the resistivity of the elastomeric polyurethane, from 0.01 to 3.0 weight percent based on the total weight of (b) of a complex of an oligoethylene glycol selected from the group consisting of di-, tri- and tetraethyleneglycol with an ionizable alkali metal salt selected from the group consisting of sodium iodide, lithium iodide and sodium thiocyanate, the coating being in electrical contact with the conductive substrate and having an electrical resistivity such that the coating is capable of transmitting a bias potential from the substrate to the outer periphery of the coating.

Since the conductivity agent disclosed and described herein functions to control or alter the resistivity of the crosslinked elastomeric polyurethane into which it is incorporated, the invention also provides, in another embodiment, a method of controlling the resistivity of a member for electrically cooperating with a photoconductive surface to attract charged toner particles from the surface towards the member, which method comprises coating a conductive substrate capable of supporting a uniform bias potential thereon with at least one coating of a resilient crosslinked elastomeric polyurethane said coating being in electrical contact with the conductive substrate and formed by reacting:

(a) a polyisocyanate prepolymer comprising the reaction product of:
  (i) an aliphatic polyisocyanate, and a polyether polyol selected from the group consiting of a polyalkylene glycol having 2 to 3 carbon atoms in the alkylene group; and
(b) a hardening mixture comprising:
  (i) a polyether polyol selected from the group consisting of a polyalkylene glycol having 2 to 3 carbon atoms in the alkylene group and,
  (ii) as a conductivity control agent to alter the resistivity of the elastomeric polyurethane from 0.01 to 3.0 weight percent based on the total weight of (b) of a complex of an oligoethylene glycol selected from the group consisting of di-, tri- and tetraethylene glycol with an ionizable alkali metal salt selected from the group consisting of sodium iodide, lithium iodide and sodium thiocyanate,
  whereby the crosslinked elastomeric polymer having an altered resistivity is capable of transmitting a bias potential from the substrate to the outer periphery thereof.

By the use of the term "biasable transfer member" or "bias transfer roll" is meant a member or roll for electrically cooperating with a conductive support surface to attract electrically charged particles from the support surface towards the member. In particular, a bias transfer roll is one which electrically cooperates with a photoconductive plate when brought into contact therewith, to attract charged toner particles from the plate in the direction of the roll. In this manner, the developed images are transferred from the photoconductor to a final support material, such as paper or the like.

Important advantages of the polyurethane coatings of the biasable transfer members of the invention are that they have an improved capability to retain pre-established levels of resistivity and are moisture insensitive.

DESCRIPTION OF THE PREFERRED EMBODIMENTS

Figure 1:
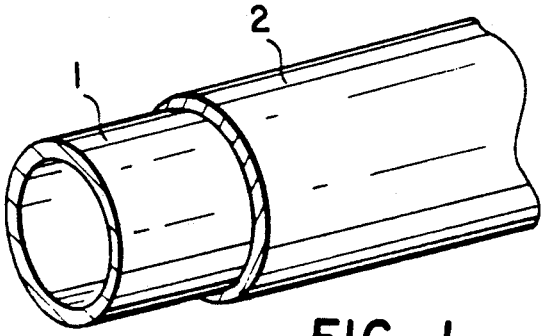
FIG. 1 is a perspective view in partial section showing the construction of a biasable transfer roll of the present invention.

The biasable transfer members of the present invention have application in any suitable electrostatographic device such as, for example, an electrophotographic device, in which a transfer member, more particularly, a bias transfer roll, is used for electrically cooperating with a photoconductive plate when brought into contact therewith to attract toner particles bearing an electrostatic charge on the plate toward the roll. Transfer is accomplished as in the prior art by feeding a sheet of transfer material into the nip region formed by the surface of the transfer roll and surface of a photoconductive insulating material bearing a developed image and imposing a potential on the transfer roll sufficient to cause the transfer of the toner particles or material from the surface of the photoconductive insulating material to the adjacent surface of the transfer material. In practice, any source of electrical power connected to the central conductive core of the transfer roll and capable of placing the transfer roll member at potential sufficient to attract toner images from the photoconductive insulating surface toward the roll may be employed. A more complete discussion of the principles and configurations involved in bias roll transfer may be found in U.S. Pat. Nos. 2,951,443, 3,620,616, 3,633,543, 3,781,105 or 3,708,482.

Referring specifically to FIG. 1, there is shown a cut-away view of a transfer member illustrating the internal construction thereof. The transfer member is in the form of a roll and is basically formed upon a rigid hollow cylinder 1 that is fabricated of a conductive metal, such as aluminum, copper or the like, capable of readily responding to a biasing potential placed thereon. Over core 1 is placed a coating 2 which is a crosslinked elastomeric polyurethane containing a conductivity control agent capable of altering or controlling the resistivity of the polyurethane to within a preferred resistivity range consistent with optimal image transfer and which is bonded convalently to the backbone and/or the crosslinking portion of the polyurethane elastomer. Outer coating 2 which is formed of the resilient elastomeric material can be designed to have a hardness of between about 10 Shore A to about 50 Shore A and preferably about 15–50 Shore A and may be about 0.125 inch (0.318 cm) to about 0.625 inch (1.58 cm) in thickness, preferably about 0.30 inch (0.762 cm) in thickness, having sufficient resiliency to allow the roll to deform when brought into moving contact with a photoconductive drum surface to provide an extended contact region in which the toner particles can be transferred between the contacting bodies. The elastomeric polyurethane coating should be capable of responding rapidly to the biasing potential to impart electrically the charge potential on the core to the outer extremities of the roll surface. It is preferred that the crosslinked polyurethane coating have a resistivity of from about $10^7$ to about $5.0\times10^{10}$ ohm cm, and, more preferably, from about $4.0\times10^9$ to $2.0\times10^{10}$ ohm cm as this has been found to be most consistent with optimal image transfer. This is achieved by including in the crosslinked polymeric network of the polyurethane elastomer the conductivity control agent of the present invention. Because the conductivity control agent is bonded covalently to the backbone and/or the crosslinking portion of the polymer, it forms a permanently fixed or integral part of the crosslinked polymer and will not migrate therefrom as in the case of prior art charge control additives which are worked into the polyurethane by direct melting of the additive into the polyurethane or by incorporating a solution or dispersion of the additive into the polyurethane. As a result, a permanent, or at the very least, a relatively constant degree of resistivity is imparted to the polyurethane elastomer that will not change substantially over time during the course of normal operations. In accordance with the present invention, the coating of the conductive substrate must be formulated of at least one layer of an elastomeric polyurethane having included in the crosslinked polymeric network thereof and bonded covalently to the backbone and/or crosslinking portions of the polymer, a conductivity control agent capable of altering and/or controlling the resistivity of the elastomer to within the preferred resistivity range. By coating the biasable transfer member with this particular class of polyurethanes the resistivity of the biasable transfer member is controlled and, in addition, the sensitivity of the resistivity of the biasable transfer member is also controlled in relationship to changes in relative humidity. Thus, the resistivity of the elastomeric polyurethanes having conductivity control agents to control the resistivity of the polyurethanes used as the outer coating of the bias transfer member of FIG. 1 is less sensitive to changes in relative humidity than elastomeric polyurethanes which are not treated with such agents. Examples of the elastomeric crosslinked polyurethane materials having conductivity control agents included in the crosslinked polymeric networks thereof as an integral part of the polyurethane material in the manner described in accordance with the invention to control the resistivity of the elastomer and hence the biasable transfer member are set forth below.

The polyurethane elastomers which can be used in accordance with the present invention are known polyurethane elastomers which are made from known starting materials using methods which are well known in the art for making polyurethane elastomers plus the conductivity control agents described herein. The conductive charge-control agents contain an ionic alkali metal salt to impart conductivity to the elastomers.

The polyurethane elastomers are the chemical reaction products of (a) polyisocyanate prepolymers formed from an excess of an isocyanate (preferably an aliphatic or cycloaliphatic polyisocyanate compound) and a polyether polyol which is a polyalkylene glycol having 2 to 3 carbon atoms in the alkylene group and (b) a hardener composition comprising at least a polyether polyol which is also a polyalkylene glycol having 2 to 3 carbon atoms in the alkylene group and an amount of the conductivity control agent described hereinbefore sufficient to control the resistivity of the polyurethane elastomer to within a range of from about $10^7$ to about $5.0\times10^{10}$ ohm cm, and more preferably, from about $4.0\times10^9$ to $2.0\times10^{10}$ ohm cm.

The polyisocyanate prepolymer can comprise recurring units derived from other polyols, polyamines and mixtures thereof, and aromatic as well as aliphatic polyisocyanates provided they do not adversely affect or in any way interfere with the relative humidity sensitivity or with the resistivity of the polyurethane in general. Exemplary polyisocyanate compounds which may be used to make the prepolymer are exemplified by those disclosed in U.S. Pat. Nos. 2,969,386 and 4,476,292 such as isophorone diisocyanate, 4,4'-diphenylmethane diisocyanate; 1,5-naphthalene diisocyanate; 3-isocyanatomethyl; 3,5,5-trimethylcyclohexyl isocyanate (isophorone diisocyanate); 4,4'-methylenebis(cyclohexylisocyanate); hexylmethylene diisocyanate; biuret of hexylmethylene diisocyanate; 1,3-cyclohexane-bis-(methylisocyanate); 2,2,4-trimethylhexylmethylene diisocyanate, and combinations thereof, as well as related aliphatic and cycloaliphatic polyisocyanates which may be substituted with other organic or inorganic groups that do not adversely affect the course of the polymerization reaction or interfere with the relative humidity sensitivity or with the resistivity of the polyurethane in general. A most preferred polyisocyanate is 4,4'-methylenebis(cyclohexylisocyanate).

The term "aliphatic", as used herein, includes those carbon chains which are substantially non-aromatic in nature. They may be saturated or unsaturated, unbranched, branched or cyclic in configuration and may contain various substituents. Such aliphatic isocyanates generally have an equivalent weight of from 60 to 160 and a viscosity of 110 to 1500.00 centipoises at 25° C.

The polyol used in preparing the polyisocyanate prepolymer is an aliphatic alkylene glycol polymer having an alkylene unit composed of 2 or 3 carbon atoms. These aliphatic alkylene glycol polymers are exemplified by polyoxyethylene glycol and polyoxypropylene glycol. The polyether polyols will generally have molecular weights of from 60–10,000 and typically 4000–8000.

Preferred concentration ranges for the respective components of the prepolymer are 5–15% by weight of polyisocyanate and 85–90% by weight polyol to form a resin prepolymer of 20–55% by weight polymer dissolved in 5–20%, by weight, of excess isocyanate.

The final conductive bulk polyurethane elastomer is produced by chain-extending and crosslinking the prepolymer with a hardener composition comprising an additional polyether polyol of the kind aforedescribed and the conductivity control agents described herein. Optionally, polyols, other than the aforementioned polyether polyols also can be included in the hardener composition along with and in addition to the polyether polyol provided they do interfere with the relative humidity sensitivity or with the resistivity of the polyurethane composition or otherwise adversely affect the properties and/or the performance of the polyurethane elastomer in effecting optimal image transfer of the biasable member on which the polyurethane is coated.

One example of additional polyols which may be included in the hardener composition in addition to the polyether polyol component of the hardener composition are amine-based polyols, such as those disclosed in U.S. Pat. No. 4,476,292. Such polyols generally have an equivalent weight of from 30 to 6000 and a viscosity of from 1.0 to 20,000 centipoises at 20° C. to 60° C. A wide variety of aromatic and aliphatic diamines may form part of the amine-based polyols. Such polyols include N,N,N',N'-tetrakis(2-hydroxypropyl)ethylenediamine and a polymer of ethylene diamine, propylene oxide and ethylene oxide. A typical aromatic amine-based polyol is available from Upjohn under the designation ISONOL 100; a typical aliphatic amine-based polyol is available from BASF under the designation QUADROL and a typical ethylene diamine/propylene oxide/ethylene oxide polymer is available from BASF under the designation PLURACOL 355.

Examples of other polyols which may be blended with or added to the polyether polyol in the hardener composition may be exemplified by those disclosed in U.S. Pat. Nos. 2,969,306; 3,445,855; 4,476,297 and 4,390,679. Such groups include aliphatic polyols and glycols such as glycerol, trimethylolpropane, 1,3-butylene glycol, hydroxylated castor oils, hydroxyl-terminated polybutadienes, alkylenebis(polycaprolactones) and the like.

It is preferred, however, that the hardener composition contain, as the sole polyol component thereof, polyoxyethylene glycol or polyoxypropylene glycol as described previously or mixtures thereof.

The polyurethane also can contain incorporated in the prepolymer and/or the hardener compositions recurring units derived from amines including hindered amines such as, for example, those disclosed in U.S. Pat. No. 4,390,679 which can serve as conventional chain extenders and/or crosslinking agents in the preparation of the polyurethane. Exemplary amines include 4,4'-methylenebis(o-chloroaniline), phenylenediamine, bis(4-aminocyclohexyl)methane, isophoronyldiamine and the reaction products of anhydrides and imides with such amines as described in U.S. Pat. No. 4,390,679.

In general, the molecular weights of the polyol component of the hardener composition will range from about 60 to 8000, preferably 1500 to 3500.

The polyurethanes are prepared by admixing the prepolymer with the polyol hardener. Catalysts and optional additives also can be included within the hardener with the proviso that they do not interfere with the relative humidity sensitivity or with the resistivity of the polyurethane. Generally, stoichiometric amounts of prepolymer and polyol are utilized, with the possibility of deviating from the stoichiometric amount by utilizing up to about 25% excess prepolymer or up to about 2% excess polyol. Solid, thermoset polyurethane elastomers can be obtained within about 40 minutes at room temperature.

Catalysts known to those skilled in the art which may be included in the hardener composition may comprise, for example, heavy metals utilized in amounts of about 0.1% metal, by weight, of hardener, e.g., organo tin, organo zinc, mercury and lead components. Tertiary amines may also be utilized.

Optional additives or addenda which may be included in the hardener composition may comprise, for example, anti-foaming agents such as glycerine, and ethyl acrylate-2-ethylhexyl acrylate copolymer, dimethyl siloxane copolymers and silicones; antioxidants such as esters of $\beta$-(3,5-di-tertbutyl-4-hydroxyphenyl)-propionic acid with monohydric or polyhydric alcohols, for example, methanol, octadecanol, 1,6-hexanediol, neopentylglycol, thiodiethylene glycol, diethylene glycol, triethylene glycol, pentaerythritol, tris-hydroxyethyl isocyanurate, and di-hydroxyethyl oxalic acid diamide; UV absorbers and light stabilizers such as 2-(2'-hydroxyphenyl)benzyltriazoles and sterically hindered amines such as bis-(2,2,6,6-tetramethylpiperidyl)-sebacate, bis-(1,2,2,6,6-pentamethylpiperidyl)-sebacate n-butyl-3,5-di-tertbutyl-4-hydroxybenzyl malonic acid, bis-(1,2,2,6,6-pentamethylpiperidyl)-ester, condensation product of 1-hydroxyethyl-2,2,6,6-tetramethyl-4-hydroxypiperidine and succinic acid, condensation product of N,N'-(2,2,6,6-tetramethylpiperidyl)-hexymethylenediamine and 4-tertoctylamino-2,6-dichloro-1,3,5-s-triazine, tris-(2,2,6,6-tetramethylpiperidyl)-nitrilotricacetate, tetrakis-(2,2,6,6-tetramethyl-4-piperidyl)-1,2,3,4-butane-tetracarbonic acid and 1,1'-(1,2-ethanedyl)-bis-(3,3,5,5-tetramethylpiperazinone); plasticizers such as phthalates, adipates, glutarates, epoxidized vegetable oils, and the like; fungicides, pigments, dyes, reactive dyes, moisture scavengers and the like.

The prepolymer-hardener mixtures prior to curing, exhibit sufficiently low viscosities to facilitate mixing, pouring and air bubble diffusion, thereby allowing for the formation of bubble free castings in the configuration of a transfer roller or belt.

Two-component polyurethane mixes of the type described above into which the conductivity control agents of the invention can be incorporated are commercially available. Examples of such commercially available polyurethane systems include CONATHANE TU-500 and CONATHANE TU-400 available from Conap, Inc., Olean, N.Y.

The degree of conductivity imparted to the polymer will vary depending upon the amount of conductivity control agent included in the combination of starting materials and the inherent properties of the given polymer and crosslinking agent (e.g., the degree of conductivity the crosslinked polymer would have if no conductivity control agent were included). Any amount of the conductivity control agent sufficient to adjust or alter the resistivity of the elastomeric polyurethane material to within the desired limits, preferably from higher or lower levels of resistivity to a resistivity in the range of from about $10^7$ to about $5\times10^{10}$ ohm cm, or within the range itself, may be used in accordance with the present invention. Resistivities in this range have been found to be consistent with optimal image transfer efficiency. In general, concentrations in the range of about 0.1 to 3.0 percent by weight, based on total weight of the crosslinked elastomeric polyurethane have been found to be appropriate for adjusting the resistivity of the polymer to within the desired limits.

Higher amounts of the conductivity control agent to control the resistivity may be used, the only limitation being the desired resistivity of the elastomeric polyurethane for use as a coating material upon the conductive substrate of the biasable transfer member.

The conductivity control agent is simply included in the desired amount in the combination of starting materials, specifically as a component of the hardener composition and bonds to the polymer backbone and/or crosslinking portion of the polymer during the normal process of crosslinking as is explained more fully below.

The conductivity control agents of the invention are low molecular weight oligomers of ethylene oxide, specifically diethylene glycol, triethylene glycol and tetraethylene glycol complexed with an ionizable alkali metal salt selected from the group consisting of sodium iodide, lithium iodide and sodium thiocyanate. Such complexes can be prepared by the evaporation of solvent from an oligomer-salt solution. They can be formed by complexing three equivalents of the ether oxygen contained in the oligomer with one equivalent of the salt. Complexation occurs by donation of a lone pair of the ether electrons of the ether oxygen atoms to the cation. Complexes of sodium thiocyanate, for example, are readily prepared by the evaporation of solvent from a methanol solution of the oligomer-salt solution.

As mentioned previously, the conductivity control agent bonds covalently to the polymer backbone and/or the crosslinking portion of the polymer. This is achieved by reaction of the hydroxyl groups of the conductivity control agent with excess isocyanate present in the prepolymer/hardener mixtures which form urethane linkages in the polymer backbone and/or the crosslinking portions of the polymer thereby firmly anchoring the conductivity control agent in the polymeric network. As a result, the conductivity control agent will not leach out of or migrate from the polymeric network. This enables the polymer to retain a relatively constant degree or level of resistivity which will not change substantially (e.g., decrease) over time during use.

In addition, the conductivity control agents used in the present invention for controlling or adjusting the resistivity of the polyurethane elastomers which form the coatings on the conductive substrates of the biasable transfer members of the invention also significantly reduce the sensitivity of the resistivity of the polyurethane to changes in the relative humidity.

By a significant reduction in the sensitivity of the resistivity to changes in relative humidity is meant a reduction of its sensitivity of at least about 97.5 percent. Reductions in relative humidity sensitivity of greater than 99.5 percent have been demonstrated by the method and compositions of the present invention.

The relative humidity sensitivities of the crosslinked elastomeric polyurethanes of the invention for making biasable transfer members by coating a conductive substrate for supporting a uniform bias potential thereon with at least one coating of the elastomeric polyurethane have been obtained by measuring the resistivity of the polyurethanes at a relative humidity of 0% and a relative humidity of 100%. The ratio of the resistivity at a relative humidity of 0% to the resistivity at a relative humidity of 100% is the relative humidity sensitivity. This relative humidity sensitivity is also referred to as the relative humidity swing. The ratio of the sensitivity at a relative humidity of 0% and a relative humidity of 100%, should be about 1 to 10 to provide a suitable biasable transfer member in accordance with the present invention. Ideally, the ratio should be 1. As mentioned above, in addition to the desirability of having a low relative humidity swing, the elastomeric polyurethanes useful for biasable transfer members must also have a resistivity of from about $10^7$ to about $5\times10^{10}$ ohm cm, and preferably from about $4.0\times10^9$ to $2.0\times10^{10}$ ohm cm. In the event a particular elastomeric polyurethane has a resistivity higher or lower than the desired resistivity, the resistivity may be adjusted by the inclusion of a suitable amount of conductivity control agent of the invention for adjusting the resistivity of the particular polymeric material as described previously.

As mentioned previously, the hardness of the elastomeric polyurethanes of the invention is between about 10 Shore A to about 50 shore A, and preferably about 15-50 Shore A. The control of the hardness is within the purview of those skilled in the art, and the hardness can be controlled by such parameters as by varying the type and amount of reactants used and by using various additives such as plasticizers.

In accordance with the invention, there is described the method of controlling the resistivity of a biasable transfer member. There is also described a method of reducing the sensitivity of the resistivity of the crosslinked elastomeric polyurethanes to changes in relative humidity by coating a conductive substrate for supporting a uniform bias potential thereon with at least one layer of a crosslinked elastomeric polyurethane having a conductivity control agent included therein characterized by being bonded covalently to the backbone and/or the crosslinking portion of the polymer to control resistivity and having a resistivity of from about $10^7$ to about $5\times10^{10}$ ohm cm, and preferably from about $4.0\times10^9$ to $2.0\times10^{10}$ ohm cm. The coating can be applied to the substrate by any suitable method or technique known in the art including spraying, casting in molds, affixing sheets of the material to the substrate member by suitable mechanical means or by suitable cement, and the like.

The following examples and comparative tests illustrate more clearly the crosslinked elastomeric polyurethane materials which may be used in preparing the biasable transfer members of the present invention and for controlling the resistivity of the biasable transfer members of the present invention, including controlling the sensitivity of the resistivity to changes in relative humidity although the invention is not to be construed as limited in scope thereby.

SAMPLE PREPARATION

Slabs of the particular elastomeric polyurethanes to be tested were cast in a steel mold in sheets to a thickness of 0.25 inch (0.635 cm). Samples of the various cast materials were placed in controlled humidity chambers for a designated number of days. One set of chambers was maintained at a relative humidity of 0% and another set of chambers was maintained at a relative humidity of 100%. A 0% relative humidity environment was obtained by suspending the test samples in a sealed jar containing 1 inch Drierite at 24° C. A 100% relative humidity environment was obtained by suspending the samples over water in a sealed jar at 24° C. The samples were suspended in the chambers in such a way that both sides were available to the atmosphere. In this manner the samples would have taken up very close to the equilibrium amounts of water within 14 days. After 14 days, the volume resistivity of the samples were measured according to the procedure of ASTM Standard D-257 by placing the samples between two soft electrodes of a known surface area, applying a 1 kilovolt DC bias from a Trek 610C Cor-A-Trol (high voltage supply) to one electrode and measuring the current from the second electrode using a Kiethyl 485 Picoammeter. Values are reported in ohm cm.

The resistivities measured at both 0% and 100% relative humidity were recorded. For the designated examples below, the ratio of the resistivity at 0% relative humidity to the resistivity at 100% relative humidity was determined. The resulting ratio was designated as the RH sensitivity or RH swing and is reported as RH sensitivity in Table I below where resistivity at 0% and 100% relative humidities is also designated for the various samples tested.

EXAMPLE 1

This example describes the preparation of a conductivity control agent useful in accordance with the invention which is a tetraethylene glycol-sodium iodide complex.

A complex of tetraethylene glycol and sodium iodide was prepared by charging to a 2 liter single-neck round bottom flask equipped with a magnetic stirrer containing 149.9 g (1.0 mole) of sodium iodide 1.0 liter of methanol. To the solution there was added 194.2 g (1.0 mole) of tetraethylene glycol. The solution was stirred for 10 minutes. The methanol was removed under reduced pressure to leave a solid material characterized by combustion analysis as tetraethylene glycol complexed with sodium iodide. Melting point=90°-93° C.; 95.55% isolated yield.

EXAMPLE 2

This example describes the preparation of a conductivity control agent useful in accordance with the invention which is a tetraethylene glycol-sodium thiocyanate complex.

A complex of tetraethylene glycol and sodium thiocyanate was prepared by charging to a 500 ml single-neck round bottom flask equipped with a magnetic stirrer containing 8.11 g (0.10 mole) of sodium thiocyanate 100 ml of methanol. To the solution there was added 19.42 g (0.10 mole) of tetraethylene glycol. The solution was stirred for 10 minutes. The methanol was removed under reduced pressure to leave a solid material characterized by combustion analysis as tetraethylene glycol complexed with sodium thiocyanate.

EXAMPLE 3

This example describes the preparation of a conductivity control agent useful in accordance with the invention which is a tetraethylene glycol-lithium iodide complex.

A complex of tetraethylene glycol and lithium iodide was prepared by charging to a 500 ml single-neck round bottom flask equipped with a magnetic stirrer containing 11.24 g (0.084 mole) of lithium iodide 100 ml of methanol. To the solution there was added 16.31 g (0.084 mole) of tetraethylene glycol. The solution was stirred for 10 minutes. The methanol was removed under reduced pressure to leave a solid material characterized by combustion analysis as tetraethylene glycol complexed with lithium iodide. Melting point=125°-127° C.; 99% yield.

EXAMPLE 4

This example describes the preparation of a conductivity control agent useful in accordance with the invention which is a diethylene glycol-sodium iodide complex.

A complex of diethylene glycol and sodium iodide was prepared by charging to a 500 ml single-neck round bottom flask equipped with a magnetic stirrer containing 14.99 g (0.10 mole) sodium iodide 100 ml methanol. To the solution there was added 31.84 g (0.3 mole) of diethylene glycol. The solution was stirred for 10 minutes. The methanol was removed under reduced pressure to leave a liquid material characterized by combustion analysis, IR and NMR as diethylene glycol complexed with sodium iodide. A 99% yield was obtained.

EXAMPLE 5

This example described the preparation of a conductivity control agent useful in accordance with the invention which is a triethylene glycol-sodium iodide complex.

A complex of triethylene glycol and sodium iodide was prepared by charging to a 500 ml single-neck round bottom flask equipped with a magnetic stirrer containing 14.99 g (0.10 mole) sodium iodide 100 ml methanol. To the solution there was added 22.53 g (0.15 mole) triethylene glycol. The solution was stirred for 10 minutes. The methanol was removed under reduced pressure to leave a solid material characterized by combustion analysis as triethylene glycol complexed with sodium iodide. Melting point=51°-54° C.; 99% yield.

EXAMPLE 6

This example describes the preparation of a 50 Durometer Shore A hardness polyurethane elastomer without a conductivity control agent of the invention as a control and the resistivity and relative humidity sensitivity of the elastomer as measured in accordance with the aforedescribed procedure.

A polyurethane was prepared from a two-component polyurethane commercial mix obtained from Conap Inc., Olean, N.Y., designated as CONATHANE TU-500, by mixing at room temperature for 5 minutes, a solution of 100.0 g CONATHANE TU-500 Part A, an isocyanate terminated prepolymer based on poly(propylene oxide), and 77.80 g CONATHANE TU-500 Part B, a hydroxyl terminated polymer based on poly(propylene oxide). The solution was degased under high vacuum, poured into a steel mold and placed in a hot air oven at 80° C. for 3 hours. The slab was then removed from the mold and placed in a hot air oven and post cured at 80° C. for 13 hours. The slab was removed from the oven and allowed to cool to room temperature. The resistivities of the resultant slab molded to a thickness of 0.25 inch (0.635 cm) were measured as described above at the two designated relative humidities and the relative humidity sensitivity was determined after an equilibrium of 14 days in a relative humidity chamber. The results are shown below in Table I, Example 6.

EXAMPLE 7

This example describes the preparation of an elastomeric polyurethane of the invention and the resistivity and relative humidity sensitivity of the elastomer as measured in accordance with the aforedescribed procedure. The example shows the preparation of the polyurethane elastomer of Example 6 except that 0.1 weight percent of the conductivity control agent of Example 1 was added to Part B of the polyurethane mix prior to the addition thereto of Part A of the mix.

A 1 liter glass beaker containing 77.33 g of CONATHANE TU-500 Part B was charged with 0.172 g of the sodium iodide-tetraethylene glycol conductivity agent prepared in accordance with Example 1. The mixture was heated to 100° C. for 30 minutes until the conductivity agent had dissolved. To the solution there was added 100 g of CONATHANE TU-500 Part A and the mixture was mechanically stirred for 5 minutes. The solution was degased under reduced pressure and the mixture was poured into a prepared steel mold and the mold was placed into an 80° C. hot air oven for 3 hours. The slab was removed from the mold and post cured at 80° C. for 13 hours. The slab was removed from the oven, cooled to room temperature and the resistivities were measured as described above at the two designated relative humidities and the relative humidity sensitivity was determined after an equilibration time of 14 days in a relative humidity chamber. The results are shown in Table I, Example 7 below.

EXAMPLE 8

This example describes the preparation of an elastomeric polyurethane of the invention and the resistivity and relative humidity sensitivity of the elastomer as measured in accordance with the aforedescribed procedure. The example shows the preparation of the polyurethane elastomer of example 6 except that 0.08 weight percent of the conductivity agent of Example 2 was added to Part B of the polyurethane mix prior to the addition thereto of Part A of the mix.

A 1 liter glass beaker containing 77.3 g of CONATHANE TU-500 Part B was charged with 0.138 g of the sodium thiocyanate-tetraethylene glycol conductivity agent prepared in accordance with Example 2. The mixture was heated to 100° C. for 30 minutes until the conductivity agent had dissolved. To the solution there was added 100 g of CONATHANE TU-500 Part A and the mixture was mechanically stirred for 5 minutes. The entrapped air was removed under reduced pressure and the mixture was poured into a prepared steel mold. The mold was placed into an 80° C. hot air oven for 3 hours, the resulting slab removed from the mold and post cured at 80° C. in a hot air oven for 13 hours. The slab was removed from the oven, cooled to room temperature and the resistivities were measured as described above at the two designated relative humidities and the relative humidity sensitivity was determined after an equilibration time of 14 days in a relative humidity chamber. The results are shown in Table I, Example 8 below.

EXAMPLE 9

This example describes the preparation of an elastomeric polyurethane of the invention and the resistivity and relative humidity sensitivity of the elastomer as measured in accordance with the aforedescribed procedure. The example shows the preparation of the polyurethane of Example 6 except that 0.14 weight percent of the conductivity agent of Example 3 was added to Part B of the polyurethane mix prior to the addition thereto of Part A of the mix.

A 1 liter glass beaker was charged with 0.21 g of the lithium iodide-tetraethylene glycol conductivity agent prepared in accordance with Example 3. The beaker was placed into a hot air oven and heated at 150° C. until the lithium iodide-tetraethylene glycol conductivity agent melted. To the beaker was added 65.90 of CONATHANE TU-500 Part B and the mixture was mechanically stirred while heated until the solution was obtained. Next, 83.88 g of CONATHANE TU-500 Part A were added to the beaker and the mixture was mechanically stirred for 5 minutes. The entrapped air was removed under reduced pressure and the mixture was poured into a prepared steel mold which was placed into an 80° C. hot air oven for 3 hours. The resulting slab was removed from the mold and post cured at 80° C. in a hot air oven for 13 hours. The slab was then cooled to room temperature and the resistivities were measured as described above at the two designated relative humidities and the relative humidity sensitivity was determined after an equilibration time of 14 days in a relative humidity chamber. The results are shown in Table I, Example 9 below.

EXAMPLE 10

This example describes the preparation of an elastomeric polyurethane outside the scope of the invention to show that the polyurethane elastomers of the present invention are superior to polyurethane elastomers of the prior art with respect to moisture stability. The example shows the preparation of a polyurethane elastomer made from the two-part CONATHANE TU-500 commercial polyurethane mix described above except that 0.075 weight percent of the conductive additive described in Example 10 of U.S. Pat. No. 4,729,925, i.e., bis[oxydiethylenebis(polycaprolactone)yl]5-sulfo-1,3-benzenedicarboxylate, methylenetriphenylphosphonium salt was added to Part B of the polyurethane mix prior to the addition of Part B to Part A of the mix.

A Twin Flow Static Mixer obtained from Liquid Control Corp. was used as the mixing vessel. A total of 3255.25 g of Part A of the CONATHANE TU-500 mix was transferred to the mixer and degassed under high vacuum for 3 hours. A 500 g quantity of Part B of the CONATHANE TU-500 mix was placed in a beaker and 43.49 g of the polyol charge control agent prepared in accordance with the method of Example 10 in U.S. Pat. No. 4,729,925 was added to the CONATHANE TU-500 Part B with stirring. Stirring was continued via a magnetic stirrer until the mixture was completely homogeneous. The mixture was then combined with 2000 g of CONATHANE TU-500 Part B and stirred thoroughly. The combined 2500 g of CONATHANE TU-500 Part B containing the 43.49 g of the polyol charge control agent described above was placed in the Twin Flow Mixer, degassed under high vacuum for about 1 hour and statically mixed with Part A of the CONATHANE TU-500 two-component mix prior to the molding operation. The weight ratio of CONATHANE TU-500 Part A to CONATHANE TU-500 Part B plus the conductive agent was 1.29 to 1.00. After mixing the degassing, the vacuum was removed and a portion of the solution of the statically mixed polyurethane was poured into a steel mold and placed in a hot air oven at 80° C. and cured for 3 hours. The slab was then removed from the mold and was post cured in a hot air oven for 16 hours at 80° C. The slab was removed from the oven and cooled to room temperature. As before, the resistivities were measured as described above at the two designated relative humidities and the relative humidity sensitivity was determined after an equilibration time of 14 days in a relative humidity chamber. The results are shown in Table I below, Example 10.

TABLE I

Humidity Sensitivities of Polyurethane Elastomers of Examples 6–10

| Example | Elastomer | Resistivity at Designated Relative Humidity 0% | Resistivity at Designated Relative Humidity 100% | Time (Days) | RH Sensitivity |
|---|---|---|---|---|---|
| 6 | CONATHANE TU-500 | $5.5 \times 10^{12}$ | $1.5 \times 10^{10}$ | 14 | 387.42 |
| 7 | CONATHANE TU-500 + NaI/TEG[a] | $4.81 \times 10^{10}$ | $1.79 \times 10^{10}$ | 14 | 2.69 |
| 8 | CONATHANE TU-500 + NaSCN/TEG | $5.16 \times 10^{10}$ | $5.47 \times 10^{9}$ | 14 | 9.43 |
| 9 | CONATHANE TU-500 + LiI/TEG | $9.73 \times 10^{9}$ | $7.04 \times 10^{9}$ | 14 | 1.38 |
| 10 | CONATHANE TU-500 + Bis[oxydiethylene-bis(polycaprolactive)yl]5-5-sulfo-1,3-benzenedicarboxylate, methyltriphenylphosphonium salt | $3.49 \times 10^{10}$ | $1.26 \times 10^{9}$ | 14 | 27.7 |

[a]sodium iodide/tetraethylene glycol

The reduction in resistivity by the use of the conductivity control agents of the invention as well as the resulting reduction in RH sensitivity is clearly shown in Table I by comparing the resistivity and the RH sensitivity of the polyurethane elastomer of Example 6 without a conductivity control agent of the present invention to the resistivities and the RH sensitivities of the polyurethane elastomers of Examples 7–9 consisting of the same polyurethane elastomer as Example 6, but containing a conductivity control agent of the present invention. Further, a comparison of the relative humidity sensitivity resistivity of the polyurethane elastomer of Example 10 containing the polyol charge-control agent of Example 10 in U.S. Pat. No. 4,729,925 with the relative humidity sensitivities of the polyurethane elastomers of Examples 7–9 consisting of the same polyurethane elastomer containing conductivity control agents of the present invention clearly shows the substantial reduction in RH sensitivity when the conductivity control agents of the present invention are used to control the resistivity of the polyurethane elastomer as compared to the polyol charge-control agents of the prior art.

EXAMPLE 11

This example describes the preparation of a 50 Durometer Shore A Hardness Polyurethane Transfer Roller made from the two-part CONATHANE TU-500 commercial polyurethane mix described above and a sodium iodide-tetraethylene glycol conductivity control agent of the present invention.

A Twin Flow Static Mixer obtained from Liquid Control Corp. was used as the mixing vessel. A total of 3242.96 g of Part A of the CONATHANE TU-500 mix was transferred to the mixer and degassed under high vacuum for 2 hours. A 500 g quantity of Part B of the CONATHANE TU-500 mix was placed in a beaker and heated to 100° C. A sodium iodide-tetraethylene glycol conductivity control agent prepared in accordance with the method of Example 1 was ground to a fine powder and added to the hot CONATHANE TU-500 Part B with stirring. The mixture was heated at 100° C. under high vacuum for 30 minutes. The stirring was continued outside the oven via a magnetic stirrer until it was completely homogeneous and close to room temperature. The mixture was then combined with 2000 g of CONATHANE TU-500 Part B and stirred thoroughly. The combined 2500 g of CONATHANE TU-500 Part B containing the 8.11 g of sodium iodide-tetraethylene glycol conductivity control agent was placed in the Twin Flow Mixer and statically mixed with Part A of the CONATHANE TU-500 two-component mix. The mixture was degassed under high vacuum for 30 minutes before the molding operation. The weight ratio of CONATHANE TU-500 Part A to CONATHANE TU-500 Part B plus the conductivity control agent was 1.29 to 1.00. After mixing and degassing, the vacuum was removed and the vessel was pressurized to approximately 5 psi (34.475 kPa) with dry nitrogen. A perforation in the shape of cylindrical roller mold was filled with the mixture from the Twin Flow Mixer after preparing the mold by thoroughly cleaning the mold, treating all areas to be exposed to the polyurethane with mold release and preheating the mold to 80° C. After filling the mold, the polyurethane was cured for 3 hours at 80° C. The roller was then removed from the mold and was post cured for 16 hours at 80° C. The mold and casting were cooled to room temperature after which the casting was deflashed. The transfer roller, having a resistivity of $6.0\times10^9$ ohm cm was then ready for use.

The above procedures are useful for different polyurethanes. Only the mixing ratios and possibly the curing cycle are altered.

The dimensions of the conductive roller are dictated by the design of the copy equipment into which the rollers or belts are to be incorporated.

Although the invention has been described in detail with particular reference to certain preferred embodiments thereof, it should be appreciated that variations and modifications can be effected within the spirit and scope of the invention.

We claim:

1. A member for electrically cooperating with a photoconductive surface to attract charged toner particles from the surface towards the member comprising a conductive substrate capable of supporting a uniform bias potential thereon and at least one coating comprising a resilient crosslinked elastomeric polyurethane formed by reacting:

(a) a polyisocyanate prepolymer comprising the reaction product of:
  (i) an aliphatic polyisocyanate, and
  (ii) a polyether polyol selected from the group consisting of a polyalkylene glycol having 2 to 3 carbon atoms in the alkylene group; and (b) a hardening mixture comprising:
  (i) a polyether polyol selected from the group consisting of a polyalkylene glycol having 2 or 3 carbon atoms in the alkylene group and,
  (ii) as a conductivity control agent for controlling the resistivity of the elastomeric polyurethane, from 0.01 to 3.0 weight percent based on the total weight of (b) of a complex of an oligoether glycol selected from the group consisting of di-tri- and tetraethylene glycol with an ionizable alkali metal salt selected from the group consisting of sodium iodide, lithium iodide and sodium thiocyanate, the coating being in electrical contact with the conductive substrate and having an electrical resistivity such that the coating is capable of transmitting a bias potential from the substrate to the outer periphery of the coating.

2. The member of claim 1 wherein the elastomeric polyurethane coating has a resistivity of from about $10^7$ to about $5\times10^{10}$ ohm cm.

3. The member of claim 1 wherein the elastomeric polyurethane coating has a resistivity of from about $4.0\times10^9$ to about $2.0\times10^{10}$ ohm cm.

4. The member of claim 1 wherein the elastomeric polyurethane has a hardness of between about 10 Shore A and about 50 Shore A.

5. The member of claim 1 wherein the conductive substrate having a coating of elastomeric polyurethane is formed of a conductive metal in the shape of an endless belt.

6. The member of claim 1 wherein the conductive substrate having a coating of elastomeric polyurethane is formed of a conductive metal in the shape of a roll.

7. The member of claim 1 wherein (a) the polyisocyanate in the prepolymer is 4,4'-methylenebis(cyclohexylisocyanate), hexamethylene diisocyanate or isophorone diisocyanate and (b) the polyether polyol is polyoxyethylene glycol, polyoxypropylene glycol, or mixtures thereof.

8. The member of claim 1 wherein (a) the polyisocyanate in the prepolymer is 4,4'-methylenebis(cyclohexylisocyanate) and (b) the polyether polyol is polyoxypropylene glycol.

9. The member of claim 1 wherein the conductivity control agent is present in an amount of 0.01 to 3.0 weight percent based on the total weight of (b).

10. The member of claim 1 wherein the conductivity control agent is a complex of sodium iodide and tetraethylene glycol.

11. The member of claim 1 wherein the conductivity control agent is a complex of lithium iodide and tetraethylene glycol.

12. The member of claim 1 wherein the conductivity control agent for controlling the resistivity further substantially reduces the sensitivity of the resistivity to changes in relative humidity.

13. A method of controlling the resistivity of a member for electrically cooperating with a photoconductive surface to attract charged toner particles from the surface towards the member comprising coating a conductive substrate capable of supporting a uniform bias potential thereon with at least one layer of a resilient elastomeric polyurethane said coating being in electrical contact with the conductive substrate and formed by reacting:

(a) a polyisocyanate prepolymer comprising the reaction product of:
  (i) an aliphatic polyisocyanate, and
  (ii) a polyether polyol selected from the group consisting of a polyalkylene glycol having 2 to 3 carbon atoms in the alkylene group; and
(b) a hardening mixture comprising:
  (i) a polyether polyol selected from the group consisting of a polyalkylene glycol having 2 to 3 carbon atoms in the alkylene group and,
  (ii) as a conductivity control agent to alter the resistivity of the elastomeric polyurethane, from 0.01 to 3.0 weight percent based on the total weight of (b) of a complex of an oligoethylene glycol selected from the group consisting of di-, tri- and tetraethylene glycol with an ionizable alkali metal salt selected from the group consisting of sodium iodide, lithium iodide and sodium thiocyanate, whereby the elastomeric polyurethane having an altered resistivity is capable of transmitting a bias potential from the substrate to the outer periphery thereof.

14. The method of claim 13 wherein the resistivity of the elastomeric polyurethane having the conductivity control agent included therein is from about $10^7$ to about $5\times10^{10}$ ohm cm.

15. The method of claim 13 wherein the resistivity of the elastomeric polyurethane having the conductivity control agent included therein is from about $4.0\times10^9$ to about $2.0\times10^{10}$ ohm cm.

16. The method of claim 13 wherein the resistivity is increased.

17. The method of claim 13 wherein the resistivity is decreased.

18. The method of claim 13 wherein the conductivity control agent is present in an amount of 0.01 to 3.0 weight percent based on the total weight of (b).

19. The method of claim 13 wherein the conductivity control agent for altering the resistivity further substantially reduces the sensitivity of the resistivity of the member to changes in relative humidity.

20. The method claim 13 wherein (a) the polyisocyanate in the prepolymer is 4,4'-methylenebis(cyclohexylisocyanate), hexamethylene diisocyanate or isophorone diisocyanate and (b) the polyether polyol is polyoxyethylene glycol, polyoxypropylene glycol, or mixtures thereof.

21. The method of claim 13 wherein (a) the polyisocyanate in the prepolymer is 4,4'-methylenebis(cyclohexylisocyanate) and (b) the polyether polyol is polyoxypropylene glycol.

22. The method of claim 13 wherein the conductivity control agent is a complex of sodium iodide and tetraethylene glycol.

23. The method of claim 13 wherein the conductivity control agent is a complex of lithium iodide and tetraethylene glycol.

24. A method of preventing changes in the resistivity of members for electrically cooperating with a photoconductive surface to attract charged toner particles from the surface towards the members caused by changes in relative humidity comprising applying at least one coating of a resilient elastomeric polyurethane formed by reacting:

(a) a polyisocyanate prepolymer comprising the reaction product of:
  (i) an aliphatic polyisocyanate, and
  (ii) a polyether polyol selected from the group consisting of a polyalkylene glycol having 2 to 3 carbon atoms in the alkylene group; and
(b) a hardening mixture comprising:
  (i) a polyether polyol selected from the group consisting of a polyalkylene glycol having 2 to 3 carbon atoms in the alkylene group and,
  (ii) as a conductivity control agent for controlling the resistivity of the elastomeric polyurethane, from 0.01 to 3.0 weight percent based on the total weight of (b) of a complex of an oligoethylene glycol selected from the group consisting of di-, tri- and tetraethylene glycol with an ionizable alkali metal salt selected from the group consisting of sodium iodide, lithium iodide and sodium thiocyanate, to a cylindrical core of electrically conductive material for electrically cooperating with the photoconductive surface when brought into contact therewith whereby the elastomer is capable of transmitting a bias potential from the core of electrically conductive material to the outer periphery thereof and significant reductions in the sensitivity of the resistivity to changes in relative humidity occur.

25. The method of claim 24 wherein the conductivity control agent is present in an amount of 0.01 to 3.0 weight percent based on the total weight of (b).

26. The method claim 24 wherein (a) the polyisocyanate in the prepolymer is 4,4'-methylenebis(cyclohexylisocyanate), hexamethylene diisocyanate or isophorone diisocyanate, and (b) the polyether polyol is polyoxyethylene glycol, polyoxypropylene glycol, or mixtures thereof.

27. The method of claim 24 wherein (a) the polyisocyanate in the prepolymer is 4,4'-methylenebis(cyclohexylisocyanate) and (b) the polyether polyol is polyoxypropylene glycol.

28. The method of claim 24 wherein the conductivity control agent is a complex of sodium iodide and tetraethylene glycol.

29. The method of claim 24 wherein the conductivity control agent is a complex of lithium iodide and tetraethylene glycol.

* * * * *